US005672116A

United States Patent [19]

Bryan et al.

[11] Patent Number: 5,672,116

[45] Date of Patent: Sep. 30, 1997

[54] APPARATUS FOR SWINGING A GOLF CLUB

[76] Inventors: Jennifer Bryan, 16747 Kehrs Mill Estates Dr., Clarkson Valley, Mo. 63005; Justin Herman, 336 Hunter Glenn Ct.; Laura Hordesky, 353 Hunters Glen Ct., both of Ellisville, Mo. 63011; Colleen Nolan, 138 Chippenham La., Clarkson Valley, Mo. 63005; Mike Pincus, 2237 Stonebriar Ridge Dr., Chesterfield, Mo. 63017; Nathan Reinhardt, 2206 Samuel Stuart Ct.; Erin Tilley, 2212 Kehrsglen Ct., both of Clarkson Valley, Mo. 63005

[21] Appl. No.: 705,712

[22] Filed: Aug. 30, 1996

[51] Int. Cl.[6] ..... A63B 53/00

[52] U.S. Cl. ..... 473/229; 473/282; 280/250.1; 280/30; 124/1

[58] Field of Search ..... 473/229, 282; 280/250.1, 30; 180/6.5; 124/1

[56] References Cited

U.S. PATENT DOCUMENTS

| | | | |
|---|---|---|---|
| 2,577,186 | 12/1951 | Florer | 473/282 |
| 2,626,151 | 1/1953 | Jenks | 473/229 |
| 3,373,612 | 3/1968 | Thompson et al. | 473/229 X |
| 3,444,729 | 5/1969 | Shobert | 473/229 X |
| 4,363,311 | 12/1982 | Rodney | 473/282 X |
| 4,661,113 | 4/1987 | Adkins | 473/282 X |
| 5,363,934 | 11/1994 | Edmund et al. | 180/6.5 |

*Primary Examiner*—George J. Marlo

*Attorney, Agent, or Firm*—Dennis C. Bremer

[57] ABSTRACT

An apparatus for assisting a disabled person play golf is described. The apparatus includes a frame, a rod, a golf club holder, and an actuator. The rod is rotatably mounted in the frame. The frame is secured to a ambulatory handicap device such as a wheelchair, walker, scooter, or golf cart. The golf club holder is connected to a distal end of the rod, and is adapted to releasably engage a golf club head. The actuator, conversely, is connected to a distal end of the rod so that the actuator is within reach of a person utilizing the handicap device. The person actuates the actuator to rotate the rod and swing the golf club head.

20 Claims, 8 Drawing Sheets

APPARATUS FOR SWINGING A GOLF CLUB

1. Field of the Invention

This invention relates generally to an apparatus for assisting persons in playing golf, and more particularly, to an apparatus that allows a person using a support to swing a golf club head while using the support.

2. Background of the Invention

Golf is a popular pastime, and millions of people enjoy the physical and mental challenges of this ancient sport. However, conventional golf requires great physical dexterity and coordination. For this reason, persons with physical disabilities have generally been excluded from golf. It is difficult enough for someone with a disability to simply traverse a golf course, let alone get in the proper position and execute the complex body motions of a conventional golf swing. It is substantially impossible for persons relying on a handicap ambulatory device, such as a wheelchair, walker, scooter or motorized cart, to take a conventional golf swing.

More particularly, golf club swings typically require a person to stand substantially vertical, and grasp a golf club shaft so that the golf club head rests against the ground. The person must then shift the weight in his or her legs, and rotate her hips, torso and arms so that the club head rotates above and behind her head. Subsequently, the person must re-rotate her hips, torso and arms while re-shifting her weight so that the club head swings and connects with a golf ball, and the swing follows through.

It is difficult for a person seated in a wheelchair or other ambulatory handicap device to swing a golf club head and strike a golf ball. Particularly, it is difficult for a person seated in a wheelchair to either shift her weight or rotate her hips, torso and arms to swing a golf club head. Rather, from the seated position, the person's knees typically prevent her arms or the golf club shaft from rotating. Furthermore, any swing generated by such person is generally a weak swing without much accuracy.

Similarly, it is difficult for a person using different ambulatory handicap devices to swing a golf club head and strike a ball. For example, a person using a walker likely is unable to release the walker and subsequently shift his weight and rotate his body as required when swinging a golf club head. Similarly, persons seated in motorized scooters, chairs, carts, and even golf carts, generally are unable to shift their weight and rotate their body to swing a golf club head.

In addition, it is difficult for persons affected by hand or arm disabilities to swing a golf club head and strike a ball. Particularly, such persons generally are unable to grip a golf club shaft with sufficient strength to swing the golf club head and strike the ball. Similarly, such persons often are unable to rotate their arms and wrists as required when swinging the golf club head.

Therefore, persons confined to wheelchairs, or required to use walkers or other ambulatory handicap devices, typically are unable to play golf. Similarly, persons with hand or arm disabilities often are unable to play golf. Furthermore, such persons are generally unable to even putt a golf ball, and thus unable to play miniature golf.

It would be desirable to enable persons confined to wheelchairs or other ambulatory handicap devices to swing a golf club head. It also would be desirable to enable persons confined to such devices to swing a golf club head with more strength. In addition, it would be desirable to enable persons having hand or arm disabilities to swing a golf club head.

SUMMARY OF THE INVENTION

An apparatus in accordance with one embodiment of the present invention assists disabled persons in playing golf, and more specifically, helps a person relying on a support apparatus such as a wheelchair to swing a golf club head. In one embodiment, the apparatus of the present invention includes a frame and a rotatable golf club holder. Particularly, the frame is attached to a wheelchair, and the rotatable golf club holder is mounted to the frame. Specifically, a rod having a distal end and a proximal end is rotatably mounted to the frame. A golf club holder is connected to the distal end of the rod, and adapted to hold a golf club shaft so that the golf club head can swing through a position adjacent the ground. An actuator is connected to the proximal end of the rod within the reach of a person seated in the wheelchair. In one embodiment, the actuator is configured to be actuated by a person having a hand or arm disability. When the actuator is actuated, the rod and golf club holder rotate so that the golf club shaft and golf club head rotate, thus swinging the golf club head.

The above-described apparatus enables the occupant of a wheelchair to swing a golf club head while seated in the chair. Further, the apparatus is believed to generate a more powerful swing for the wheelchair occupant than such occupant can accomplish alone. In addition, the apparatus enables persons affected with hand or arm disabilities to swing a golf club head. These and other features and advantages will be in part apparent, and in part pointed out hereinafter.

DETAILED DESCRIPTION OF THE DRAWINGS

Figure 1:
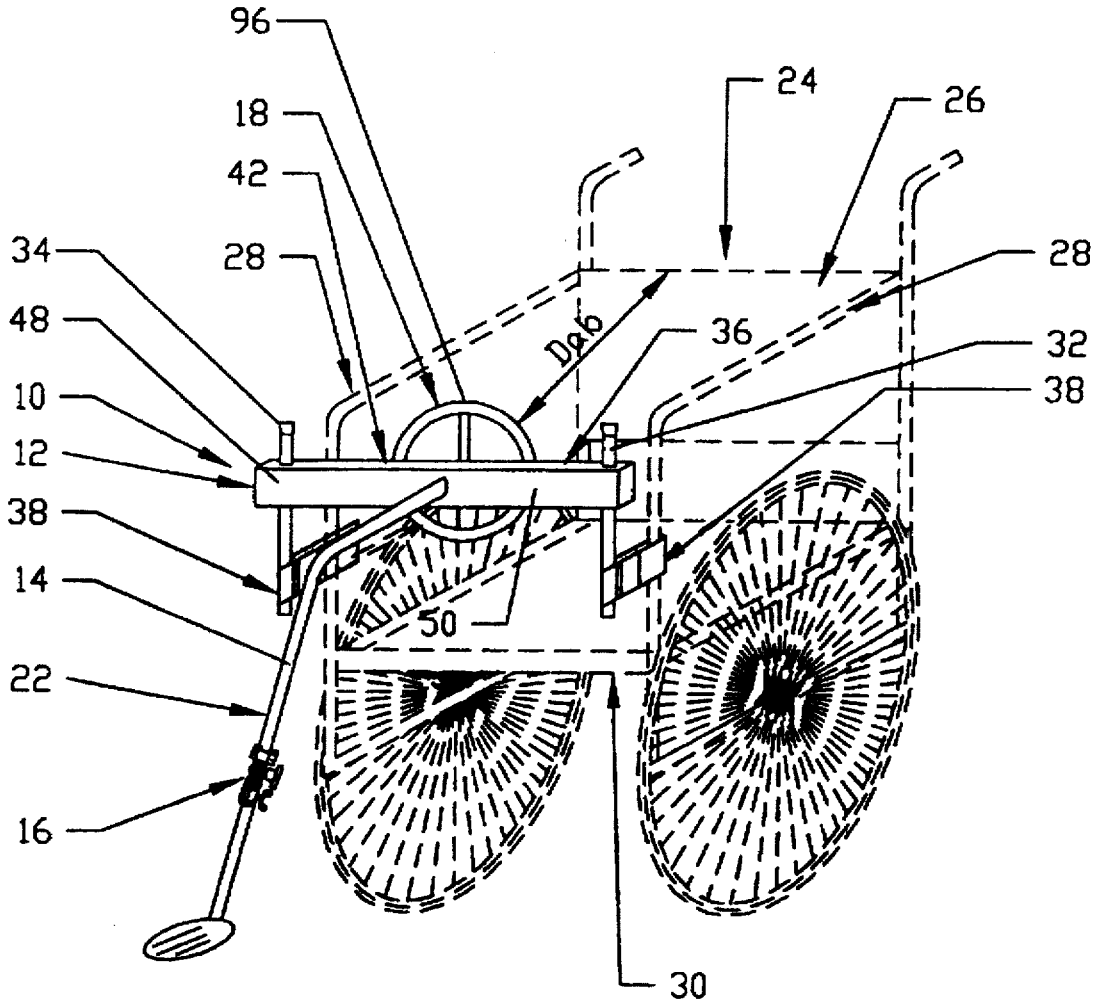
FIG. 1 is a perspective view of an apparatus constructed in accordance with one embodiment of the present invention attached to a wheelchair.
Figure 2:
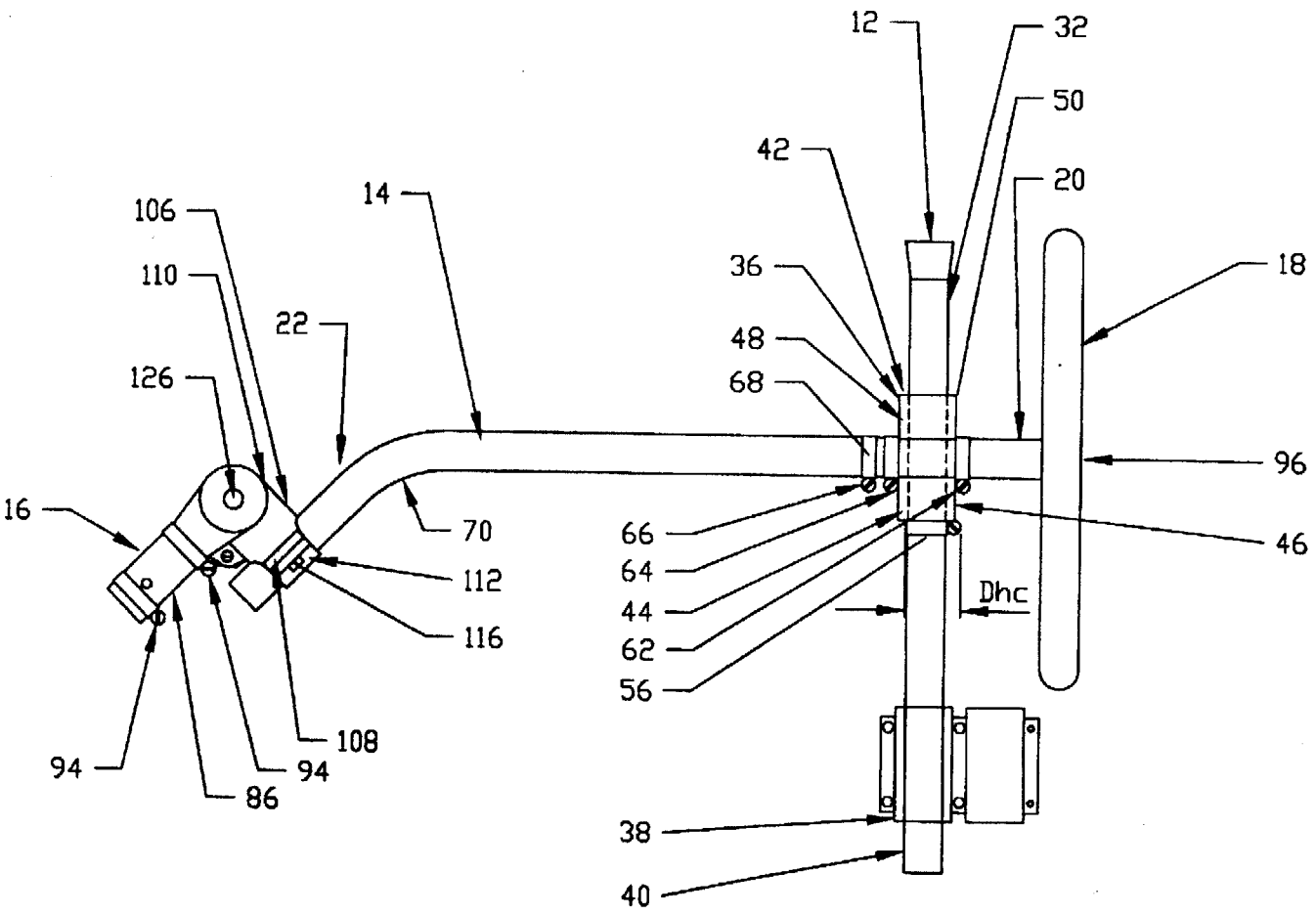
FIG. 2 is a side elevation view of the apparatus of FIG. 1.
Figure 3:
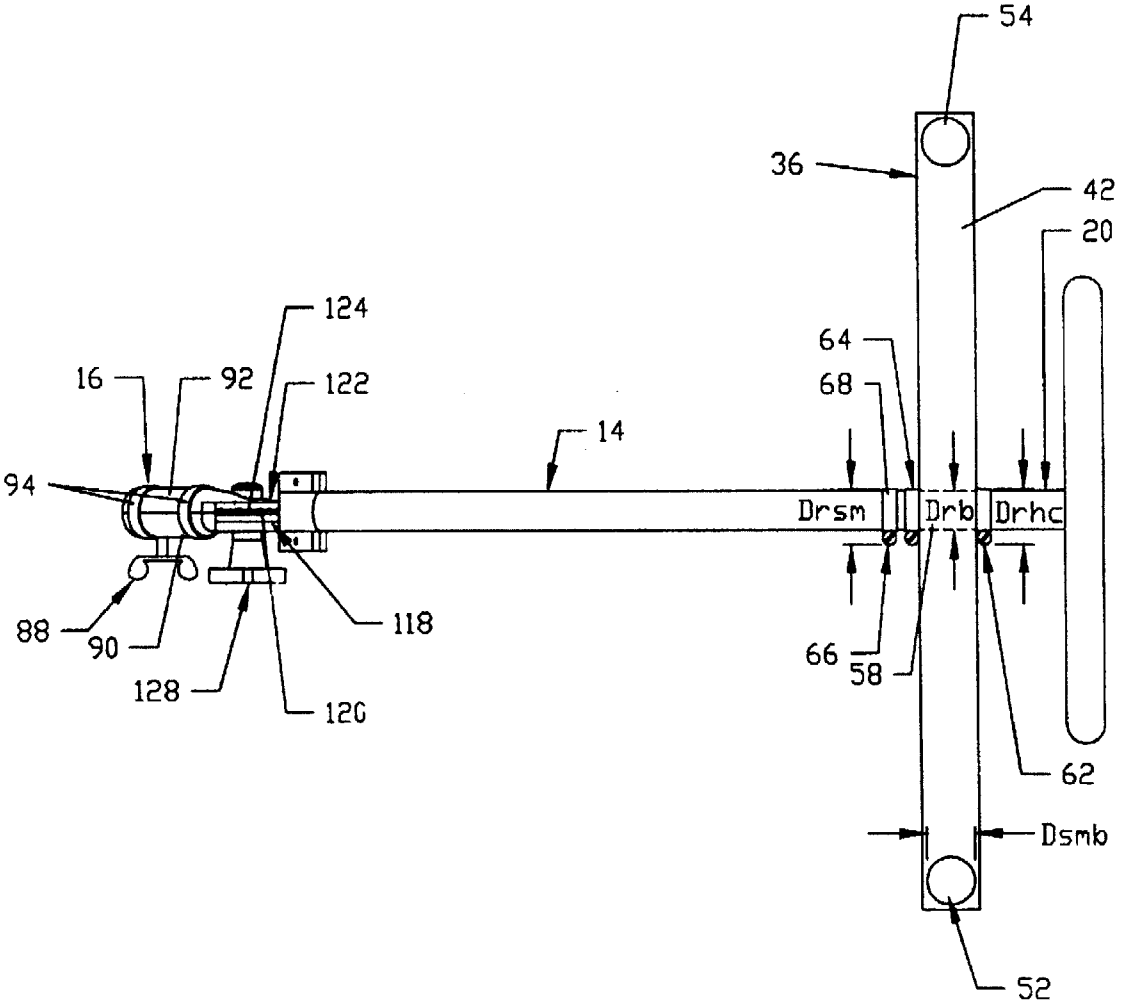
FIG. 3 is top view of the apparatus of FIG. 1.
Figure 4:
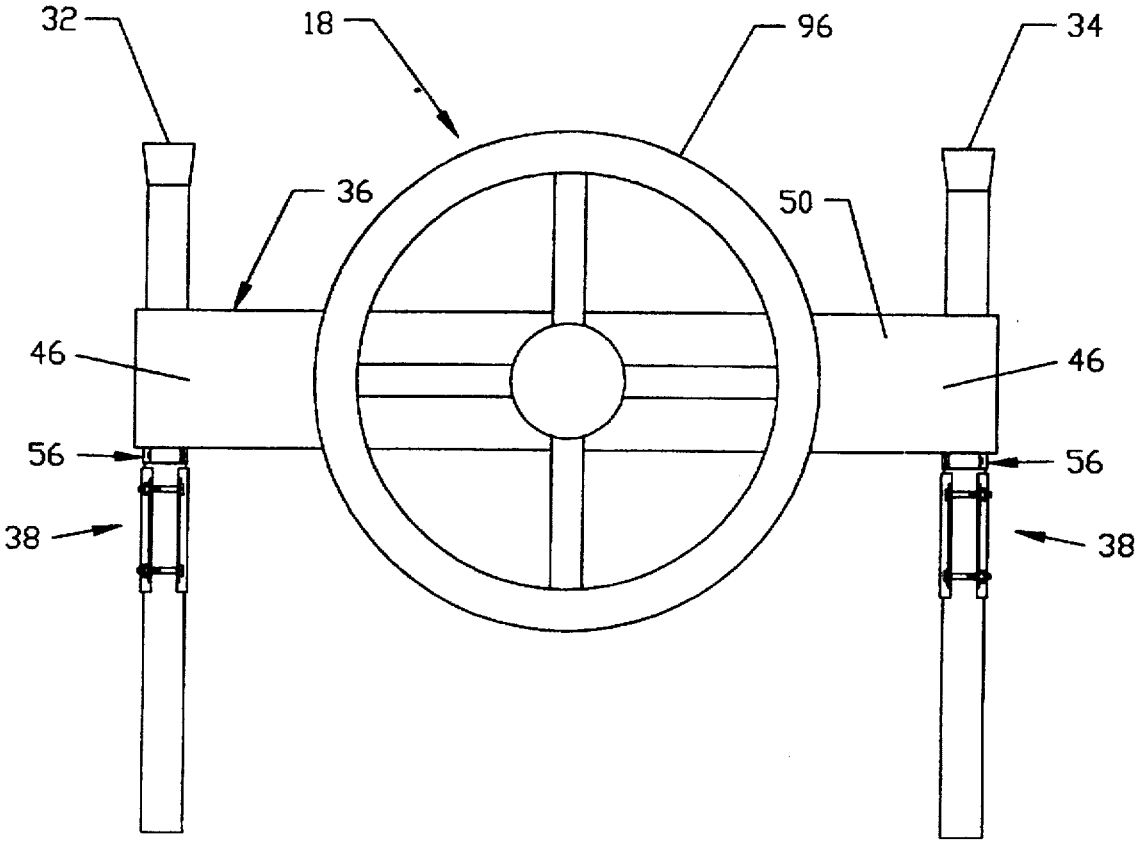
FIG. 4 is a front elevation view of the apparatus of FIG. 1.

An apparatus for swinging a golf club constructed according to the principles of this invention is indicated generally as 10 in the Figures. Referring to FIGS. 1, 2, 3 and 4, a golf club swinging apparatus 10 in accordance with one embodiment of the present invention includes a frame 12, a rod 14, a golf club holder 16, and an actuator 18. The rod 14 has a proximal end 20 and a distal end 22, and is mounted to the frame 12 so that the rod 14 extends through the frame 12 with its proximal end 20 and its distal end 22 on opposite sides of the frame 12. The golf club holder 16 is connected to the rod 14 at its distal end 22. The actuator 18, however, is connected to the rod 14 at its proximal end 20.

The apparatus 10 is configured to releasably connect with an ambulatory device such as a walker, motorized cart, wheel chair, scooter or even a golf cart. Particularly, and for example only, the following discussion describes apparatus 10 configured to be used with a wheelchair 24. However, apparatus 10 may be used with other ambulatory devices.

In accordance with one embodiment of the present invention, the frame 12 is releasably connected to the wheelchair 24 having a back 26 and two arms 28 on either side of a seat 30. Particularly, the frame 12 is connected to the wheelchair arms 28 so that the actuator 18 is generally adjacent an occupant (not shown) of the wheelchair 24 and so that the occupant can reach the actuator 18.

The frame 12 includes two support members 32 and 34 connected by a rod holder 36. The support members 32 and 34 are adapted to releasably secure to the wheelchair arms 28. Particularly, a clamp 38 is attached to one end 40 of each support member 32 and 34. Each clamp 38 is adapted to secure support members 32 and 34, respectively, to the wheelchair arms 28, in a position where the occupant of the wheelchair 24 can reach the actuator 18. In one embodiment, the support members 32 and 34 are cylindrical rods, however the support members 32 and 34 may be shaped differently.

The rod holder 36 has a top surface 42 a bottom surface 44, a proximal surface 46 and a distal surface 48. The rod holder 36 can be a 2×4 block 50 of wood. Two support member bores 52 and 54 each extend through the block 50 of wood from the top surface 42 to the bottom surface 44 and in between proximal surface 46 and distal surface 48. The support members 32 and 34 extend through the support member bores 52 and 54 so that the rod holder 36 is slidable mounted on the support members 32 and 34. This slidable mounting permits the rod holder 36 to be either raised or lowered with respect to the seat 30, so that the occupant can adjust the relative height of the rod holder 36 with respect to the seat 30.

In one embodiment, hose clamp 56 are used to adjustably fix the relative height of the rod holder 36 with respect to the seat 30. Particularly, the hose clamps 56 are slidably attached to the support members 32 and 34 so that a hose clamp outer diameter $D_{hc}$ is larger than a support member bore diameter $D_{smb}$. Thus, the rod holder 36 may not slide past hose clamps 56.

The rod holder 36 also includes a rod bore 58 extending from the proximal surface 46 to the distal surface 48. The rod 14 is rotatably mounted within the rod bore 58 so that the rod distal end 22 protrudes from the distal surface 48 and the rod proximal end 20 protrudes from the proximal surface 46.

Figure 5:
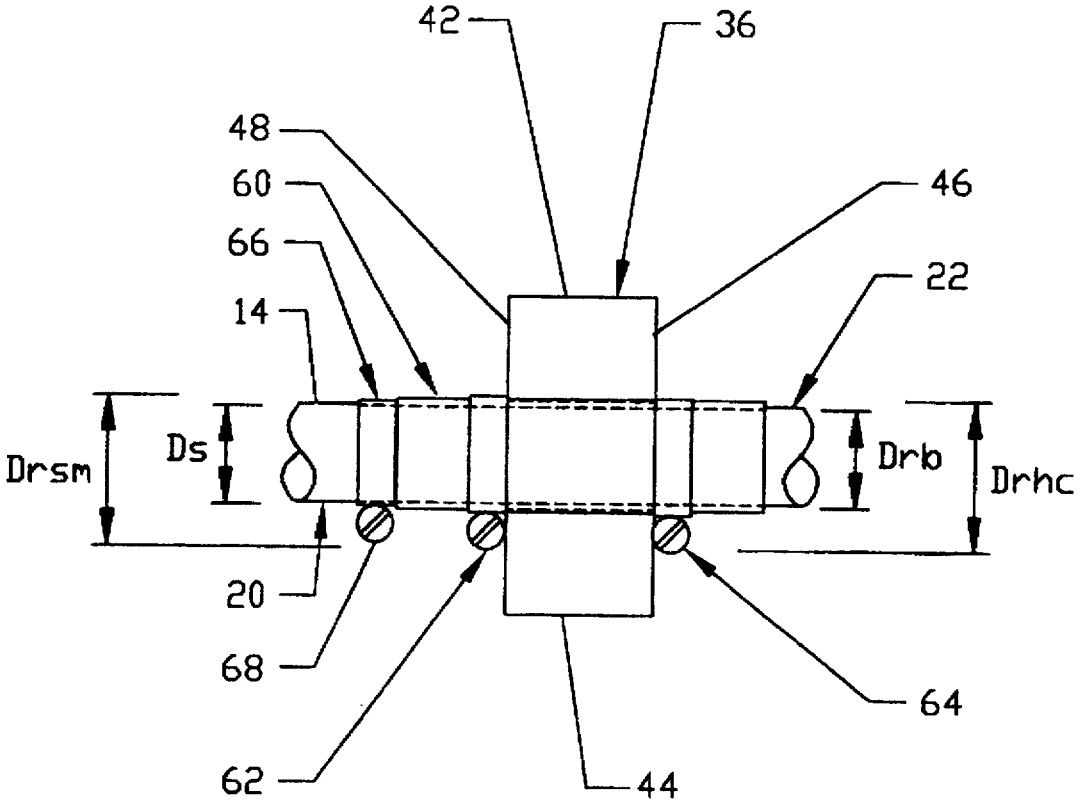
FIG. 5 is a side elevation view of a rod holder, rod, and sleeve, in accordance with one embodiment of the present invention.
Figure 6A:
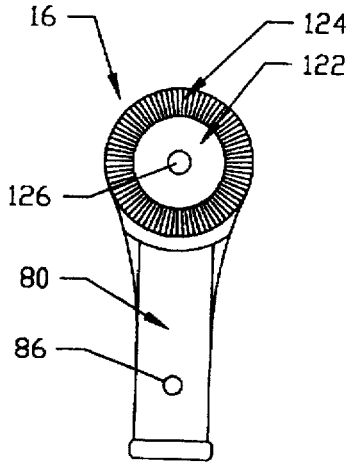
FIG. 6*a* is a side elevation view of a golf club holder in accordance with one embodiment of the present invention
Figure 6B:
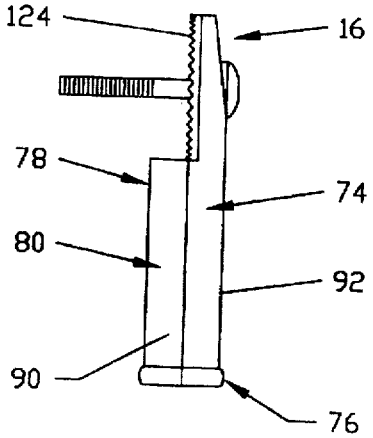
FIG. 6*b* is a front elevation view of the golf club holder of FIG. 6*a*.
Figure 6C:
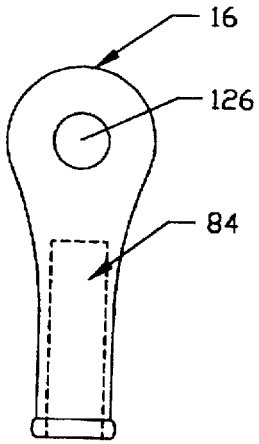
FIG. 6*c* is an opposing side elevation view of the golf club holder of FIG. 6*a*.
Figure 6D:
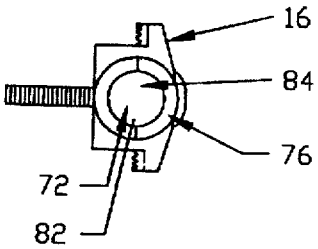
FIG. 6*d* is a bottom view of the golf club holder of FIG. 6*a*.

Referring to FIG. 5, the apparatus of the present invention 10 also includes a rod sleeve 60 for rotatably mounting the rod 14 within the rod bore 58. The rod sleeve 60 is mounted within the rod bore 58 so that it extends through the rod bore 58. Sleeve engaging members 62 and 64 are used to secure the rod sleeve 60 within the rod bore 58. In one embodiment, the sleeve engaging members 62 and 64 are hose clamps disposed on the sleeve 60 on opposing sides of rod holder 36. The hose clamps have an outer diameter $D_{rhc}$ larger than a rod bore diameter $D_{rb}$. However, the sleeve 60 may be mounted within the rod bore 58 by other known means, such as by brazing or by gluing. The rod 14 is rotatably mounted coaxially within the rod sleeve 60 so that it extends through the rod sleeve 60.

Referring again to FIGS. 1–4, the rod 14 is slidably mounted within the rod bore 58 so that a distance $D_{ab}$ between the actuator 18 and the wheelchair back 26 may be shortened or lengthened. Particularly, the rod 14 is slidably engaged to the rod holder 36 so that the rod 14 may move relative to the rod holder 36 and coaxially with the rod bore 58. A rod stop member 66 is attached to the rod 14 on either side of the rod holder 36. The attached rod stop member 66 has an outer diameter $D_{rsm}$ greater than the rod bore diameter $D_{rb}$, and prevents the rod 14 from sliding beyond the rod stop members 66. In accordance with another embodiment, the attached rod stop member's outer diameter $D_{rsm}$ is greater than a sleeve 60 inner diameter $D_s$. Particularly, while the stop member 66 permits the rod 14 to rotate, the stop member 66 limits rod movement coaxial with the rod bore 58.

In one embodiment, the rod stop member 66 is a hose clamp 68. However, other means may be used to permit limited rod movement coaxial with the rod bore 58.

The rod 14 includes a bend 70 so that the rod's proximal end 20 is not parallel to the rod's distal end 22. More specifically, the distal end 22 extends at an angle relative to the proximal end 20 so that when the proximal end 20 extends generally horizontally, the distal end 22 slants downwardly. Therefore, when the rod 14 rotates, the proximal end 20 remains generally horizontal while the distal end 22 rotates from a generally downward slant to a generally upward slant.

The golf club holder 16 is connected to the rod distal end 22. Referring to FIGS. 6*a*, 6*b*, 6*c*, and 6*d*, the golf club holder 16 has a golf club cavity 72, or socket, therein. The golf club cavity 72 is adapted to releasably receive at least a portion of a golf club shaft therein, so that the golf club shaft extends from the cavity 72. Particularly, the golf club holder 16 is a generally cylindrical tube 74 having two ends 76 and 78, and a sidewall 80 connecting the ends 76 and 78. The first end 76, as shown, has an aperture 82 therein, and an opening 84 extends from the aperture 82 to the second end 78 to form the golf club cavity 72.

Further, and in one embodiment, the sidewall 80 has a club set aperture 86 which is configured to receive a screw 88 therein. Particularly, and when a golf club shaft is within the cavity 72, the screw 88 may be inserted through club set aperture 86 to engage the shaft, and secure the shaft within the cavity 72.

In yet another embodiment, the club holder 16 includes first and second semi-cylindrical portions 90 and 92. As shown, the semi-cylindrical portions 90 and 92 are adapted to interconnect to form the golf club cavity 72. The semi-cylindrical portions 90 and 92 may be connected by any known means. For example only, hose clamps 94 may be used to connect the portions 90 and 92.

Referring again to FIGS. 1, 2, 3 and 4, actuator 18, in one embodiment, is a swing wheel 96. The swing wheel 96 is connected to the proximal end 20 of the rod 14 so that when wheel 96 rotates, the rod 14 and the club holder 16 rotate. The swing wheel 96 may be a steering wheel, a disc, or even a turntable from a record player. The swing wheel 96 is configured to be actuated by a person having a hand or arm disability. For example, the swing wheel 96 may have a large circumference, or a large actuating surface permitting a person to swing the swing wheel 96 even if the person has a prosthetic hand, or does not have a hand at all. Similarly, swing wheel 96 may have knobs, grips, or a textured surface, such as rubber, to facilitate movement of the wheel, even without a hand or with a prosthetic hand.

Figure 7:
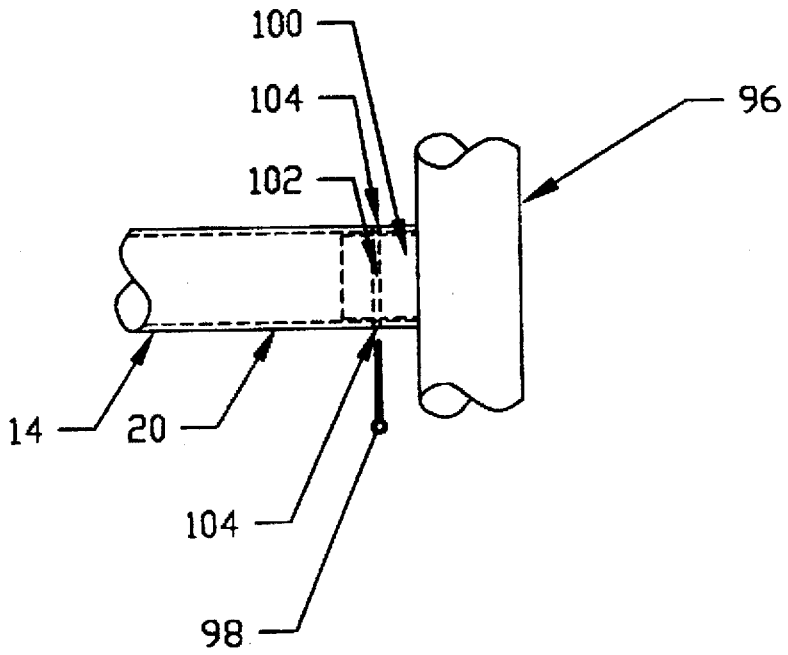
FIG. 7 is a side elevation view of the actuator and rod in accordance with one embodiment of the present invention.

The swing wheel 96 may be connected to the proximal end 20 of the rod 14 by any known means. By way of example only, and referring to FIG. 7, the wheel 96 may be attached to the rod 14 with a cotter pin 98. Specifically, the swing wheel 96 may include a mounting tube 100 extending therefrom. The mounting tube 100, as shown, is inserted into the rod's proximal end 20. The cotter pin 98 is inserted through a cotter pin bore 102 in the mounting tube 100 and cotter pin apertures 104 in the rod's distal end 22, thus securing the rod 14 to the swing wheel 96. However, the swing wheel 96 may be directly soldered to the rod 14, or secured to the rod 14 by other means.

The apparatus of the present invention 10 may also include a club angle pivot member 106 having two sides 108 and 110. The first side 108 is connected to the distal end 22 of the rod 14, while the second side 110 is connected to the golf club holder 16. In one embodiment, the first side 108 is slidably connected to the rod 14 so that club angle pivot member 106 may slide coaxially along rod 14.

Figure 8A:
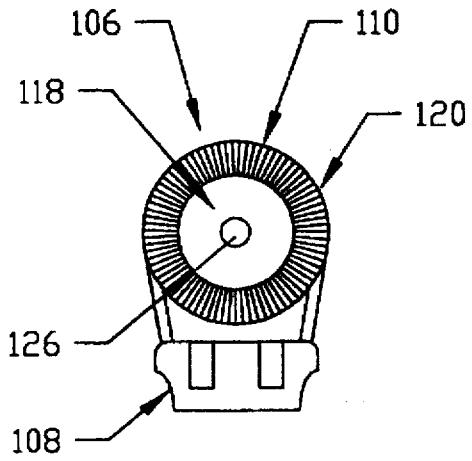
FIG. 8*a* is a side elevation view of a club angle pivot member in accordance with one embodiment of the present invention.
Figure 8B:
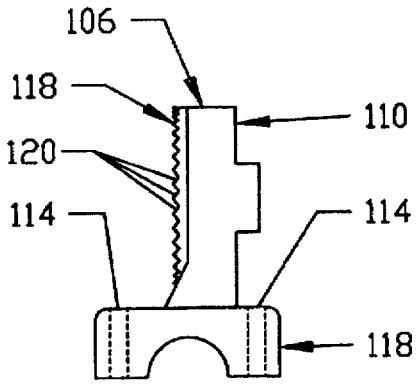
FIG. 8*b* is a back elevation view of the golf club holder of FIG. 8*a*.
Figure 8C:
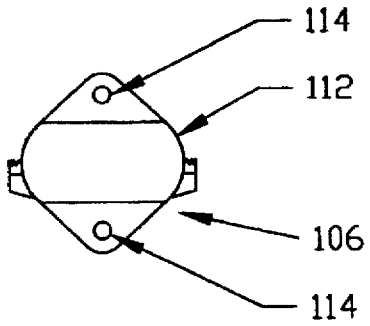
FIG. 8*c* is a bottom view of a clamp for the club holder of FIG. 8*a*.

Referring to FIGS. 8*a*, 8*b*, and 8*c*, the first side 108 of the club angle pivot member 106 is adapted to be clamped to the rod 14 with a clamp 112. More particularly, and referring to FIG. 8*c*, the first side 108 may include clamping bores 114 extending therethrough. The clamp 112, including clamp screws 116 is then secured to the first side 108 opposite the rod 14 so that the club angle pivot member 106 is connected to the rod 14.

The second side 110, however, is pivotally connected to golf club holder 16 so that the golf club holder 16 may pivot with respect to the rod 14. More particularly, the club angle pivot member 106 enables the golf club holder 16 to pivot in a plane generally perpendicular to the plane of rod 14 rotation.

As shown in FIGS. 8*a*, 8*b*, and 8*c*, the club angle pivot member's second side 110 includes a generally circular face 118 with pivot member ratchet teeth 120 dispersed coaxially thereon. Similarly, and referring again to FIGS. 6*a*–6*c*, the golf club holder 16 includes a generally circular face 122 with club holder ratchet teeth 124 mounted radially thereon. As shown, the golf club holder face 122 is adjacent to, and aligned with the club angle pivot member face 118 so that the club holder ratchet teeth 124 and the pivot member ratchet teeth 120 are disposed to interconnect with each other. Furthermore, in one embodiment, the faces 118 and 122 each include a setting aperture 126 therein, and are aligned so that the setting apertures 126 are aligned, and a setting pin 128 (FIG. 3) may be inserted through the setting apertures 126 to secure face 118 to face 122 at a club angle θ. As used herein, the club angle θ is the angle that the golf club holder 16 makes with respect to the rod distal end 22. The setting pin 128 may be a cylindrical pin, a screw, or other fastening device. In one embodiment, the club angle pivot member 106 and the golf club holder 16 are constructed from the handle of a golf pull cart.

In operation, and in accordance with one embodiment of the present invention, the support members 32 and 34 are secured to an ambulatory handicap device, or support, so that the proximal surface 46 of the rod holder 36 faces the back 26 of the device. Particularly, and with respect to wheelchair 24, one support member 32 is connected to one wheelchair arm 28, and another support member 34 is connected to the other wheelchair arm 28. The support members 32 and 34 are connected to the wheelchair 24 so that the support members 32 and 34 are generally perpendicular with respect to the ground, i.e., generally parallel with the back 26 of the wheelchair 24. The vertical height of the rod holder 36 with respect to the ground may be adjusted by sliding the rod holder 36 coaxially with respect to the support members 32 and 34. Furthermore, the support members 32 and 34 are attached to the wheelchair so that the swing wheel 96 is within reach of an occupant seated in the wheelchair.

While seated in the wheelchair 24, the occupant rotates the golf club holder 16 so that the aperture 82 in the first end 76 of the golf club holder 16 is generally in front of the occupant. The occupant inserts a club shaft into golf club holder cavity 72 and secures the club shaft within the golf club holder. Particularly, the club set screw 88 is inserted into the club set aperture 86 to secure the golf club shaft within club holder cavity 72.

After securing the club shaft to the golf club holder 16, the golf club holder 16 is rotated so that the club shaft extends generally away from the wheelchair 24. The swing wheel 96 is then rotated so that the distal end 22 of the rod 14 and the club shaft extend generally downwardly. Particularly, the swing wheel 96 is rotated to a first position where a golf club head attached to the golf club shaft is adjacent the ground and adjacent a golf ball. In accordance with one embodiment, the setting pin 128 is inserted into the setting apertures 126 to secure the club angle pivot member 106 to the golf club holder 16, thereby stabilizing the club angle θ.

The swing wheel 96 is then rotated from the first position to a second position, wherein the distal end 22 of the rod 14, the golf club holder 16, and the golf club shaft rotate from a generally downward position to a generally upward position. In accordance with one embodiment, swing wheel 96 is rotated so that rod 14 rotates approximately 180 degrees, however, the rod may be rotated either more or less than 180 degrees. From the second position, the swing wheel 96 is re-rotated to the first position, so that the club head strikes the golf ball.

The above-described apparatus enables a wheelchair occupant to swing golf club and strike a golf ball. Furthermore, the apparatus enables the wheelchair occupant to strike the ball with more power than without the apparatus.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. For example, while the handicap device is a wheelchair, other ambulatory devices including walkers, scooters, carts, and even golf carts, may be used. Similarly, while the golf club holder is described as slidably attached to the rod, such attachment may be permanent. Accordingly, the spirit and scope of the invention are to be limited only by the terms of the appended claims.

What is claimed is:

1. An apparatus for assisting a disabled person play golf, said apparatus comprising a frame, said frame adapted to releasably connect to a handicap device;

a rod having proximal and distal ends, said rod rotatably mounted to said frame;

a golf club holder connected to said rod distal end, said golf club holder adapted to releasably engage a golf club head; and an actuator, said actuator connected to said rod proximal end for turning said rod thereby swinging said golf club head.

2. An apparatus in accordance with claim 1 wherein said handicap device is a wheelchair.

3. An apparatus in accordance with claim 1 wherein said rod has a bend between said distal and said proximal ends.

4. An apparatus in accordance with claim 1 wherein said golf club holder includes a socket, and wherein said golf club head includes at least a portion of a golf club shaft, and said socket is adapted to releasably secure said shaft portion therein.

5. An apparatus in accordance with claim 1 wherein said golf club head includes at least a portion of a golf club shaft, and said golf club holder comprises a tube having two ends, said first end having an aperture therein, and an opening extending from said aperture to said second end, said opening adapted to receive at least a portion of said golf club shaft therein.

6. An apparatus in accordance with claim 1 wherein said actuator comprises a wheel, and said wheel is connected to said rod proximal end so that when said wheel is turned, said rod rotates thereby swinging said golf club head.

7. An apparatus in accordance with claim 1 wherein said frame comprises at least one support member and a rod holder, each said support member adapted to releasably connect to said handicap device, and said rod holder comprising a first and second surface, and an opening extending from said first surface to said second surface, and wherein said rod extends through said opening.

8. An apparatus for assisting a handicapped person playing golf, said apparatus comprising:

a handicap device for supporting the handicapped person;

a frame releasably mounted on said handicap device;

a rod, having proximal and distal ends, said rod rotatably mounted to said frame;

a golf club holder connected to said rod distal end, said golf club holder adapted to releasably engage a golf club head; and an actuator, said actuator connected to said rod proximal end for turning said rod thereby swinging said golf club head.

9. An apparatus in accordance with claim 8 wherein said golf club holder includes a socket, and wherein said golf club head includes at least a portion of a golf club shaft, and said socket is adapted to releasably secure said shaft portion therein.

10. An apparatus in accordance with claim 8 wherein said golf club head includes at least a portion of a golf club shaft, and said golf club holder comprises a tube having two ends, said first end having an aperture therein, and an opening extending from said aperture to said second end, said opening adapted to receive at least a portion of said golf club shaft therein.

11. An apparatus in accordance with claim 8 wherein said actuator comprises a wheel, and said wheel is connected to said rod proximal end so that when said wheel is turned, said rod rotates thereby swinging said golf club head.

12. An apparatus in accordance with claim 8 wherein said handicap device comprises a wheelchair.

13. An apparatus in accordance with claim 12 wherein said wheelchair comprises a seat and two arms, said arms on opposite sides of said seat, and wherein said frame is releasably mounted on at least one of said arms.

14. An apparatus in accordance with claim 13 wherein said frame comprises at least one support member and a rod holder, each said support member adapted to releasably connect to said handicap device, and said rod holder comprising a first and second surface, and an opening extending from said first surface to said second surface, and wherein said rod extends through said opening so that said rod proximal end is in front of a person sitting in said wheelchair.

15. In combination with a wheelchair of the type having a seat and two arms on opposite sides of the seat, an apparatus comprising:

a frame connected to the wheelchair;

a rod, having proximal and distal ends, said rod rotatably mounted to said frame so that said proximal end is nearer to said wheelchair than said distal end;

a golf club holder connected to said rod distal end, said golf club holder adapted to releasably engage a golf club head; and an actuator, said actuator connected to said rod proximal end for turning said rod thereby swinging said golf club head, said actuator generally adjacent an occupant of said wheelchair.

16. A combination in accordance with claim 15 wherein said actuator comprises a wheel.

17. A combination in accordance with claim 15 wherein said frame comprises a support member and a rod holder, said support member connected to at least one of the wheelchair arms, and said rod holder connected to said support member, said rod holder comprising a first and second surface, and an opening extending from said first surface to said second surface, and wherein said rod extends through said opening so that said rod distal end protrudes from said second surface and said rod proximal end protrudes from said first surface.

18. A combination in accordance with claim 15 wherein said golf club head includes at least a portion of a golf club shaft, and said golf club holder comprises a tube having two ends and a sidewall extending from said first end to said second end, said first end having an aperture therein, and a cavity extending from said aperture to said second end, said cavity adapted to receive at least a portion of said golf club shaft therein.

19. A combination in accordance with claim 18 wherein said tube sidewall comprises an aperture therein, said aperture configured to receive a screw therein so that said golf club shaft may be releasably secured within said cavity.

20. A combination in accordance with claim 15 further comprising a club angle pivot member, said club angle pivot member having a first end slidably connected to said rod distal end, said club angle pivot member having a second end pivotally connected to said golf club holder so that said golf club holder may pivot with respect to said rod.

* * * * *